US005930877A

United States Patent [19]

Thorpe et al.

[11] Patent Number: 5,930,877

[45] **Date of Patent: *Aug. 3, 1999**

[54] PEEL SEAL ZIPPER TAPE

[75] Inventors: Charles C. Thorpe, Des Plaines; Gregory J. Pagnier, Bourbannais; Lawrence Share, Skokie, all of Ill.

[73] Assignee: Illinois Tool Works Inc., Glenview, Ill.

[ * ] Notice: This patent is subject to a terminal disclaimer.

[21] Appl. No.: 09/129,050

[22] Filed: Aug. 4, 1998

Related U.S. Application Data

[63] Continuation of application No. 08/883,465, Jun. 26, 1997, Pat. No. 5,832,570, which is a continuation-in-part of application No. 08/652,338, May 22, 1996, Pat. No. 5,774,954.

[51] Int. Cl.[6] ..... B65D 33/16

[52] U.S. Cl. ..... 24/587; 24/304

[58] Field of Search ..... 24/30.5 R, 30.5 P, 24/587, 304, DIG. 11; 383/210, 211, 61, 63

[56] References Cited

U.S. PATENT DOCUMENTS

| | | | |
|---|---|---|---|
| 4,756,414 | 7/1988 | Mott | 383/63 X |
| 4,906,494 | 3/1990 | Babinec et al. | 383/63 X |
| 5,004,356 | 4/1991 | Matsui | 383/63 |
| 5,005,707 | 4/1991 | Hustad et al. | 383/210 |
| 5,216,787 | 6/1993 | Custer et al. | 24/587 |
| 5,358,334 | 10/1994 | Simonsen | 383/61 X |
| 5,462,360 | 10/1995 | Tilman et al. | 24/587 X |
| 5,474,382 | 12/1995 | May | 383/63 X |
| 5,486,051 | 1/1996 | May | 383/63 X |
| 5,489,252 | 2/1996 | May | 24/587 X |
| 5,551,127 | 9/1996 | May | 24/30.5 R X |

*Primary Examiner*—James R. Brittain

*Attorney, Agent, or Firm*—Kane,Dalsimer,Sullivan, Kurucz,Levy,Eisele and Richard, LLP

[57] ABSTRACT

A peel seal zipper tape for reclosable plastic bags or packages includes a first and a second mutually interlocking zipper profile disposed on a top surface of a laminated film strip. The top surface is formed by a layer of a sealant material. The laminated film strip also has a middle layer, or core, of a material stiffer than the first and second mutually interlocking zipper profiles, and may also have a bottom layer of a sealant material. In use, the laminated film strip is folded over, and the zipper profiles are interlocked with one another. In doing so, portions of the top surface of the laminated film strip face inwardly, so that the folded film strip may be closed with a heat seal. The outside of the folded peel seal zipper tape, that is, the bottom layer of sealant material is bonded to plastic sheet material from which reclosable plastic bags or packages are made. In the production of the bags or packages, the mutually facing portions of the laminated film strip are sealed together. The resulting seal gives a visual indication of having been broken when initially opened.

7 Claims, 5 Drawing Sheets

PEEL SEAL ZIPPER TAPE

CROSS-REFERENCE TO RELATED APPLICATIONS

The present application is a Continuation of application Ser. No. 08/883,465 filed Jun. 26, 1997 (which issued as U.S. Pat. No. 5,832,570) which in turn is a Continuation-in-Part of application Ser. No. 08/652,338 filed May 22, 1996 (which issued as U.S. Pat. No. 5,774,954).

BACKGROUND OF THE INVENTION

1. Field of the Invention

The present invention relates, in general, to the packaging art, and, more particularly, is concerned with a continuous reclosable plastic zipper of a type which is used to close the mouth of a bag or package, and which includes a tamper-evident, non-reclosable peel seal with a feature giving a clear indication of the integrity of the peel seal.

2. Description of the Prior Art

In the use of plastic bags and packages, is particularly for foodstuffs, it is important that the bag be hermetically sealed until the purchaser acquires the bag and its contents, takes them home, and opens the bag or package for the first time. It is then commercially attractive and useful for the consumer that the bag or package be reclosable so that its contents may be protected. Flexible plastic zippers have proven to be excellent for reclosable bags, because they may be manufactured with high-speed equipment and are reliable for repeated reuse. A typical zipper is one which has a groove at one side of the bag mouth and a rib at the other side, which rib may interlock into the groove when the sides of the mouth of the bag are pressed together. Alternatively, a member having a plurality of ribs may be on one side of the bag mouth, while a member having a plurality of channels may be on the other side, the ribs locking into the channels when the sides of the mouth of the bag are pressed together. In such a case, there may be no difference in appearance between the two members, as the ribs may simply be the intervals between channels on a strip which may lock into another of the same kind. In general, and in short, some form of male/female interengagement is used to join the two sides of the bag mouth together. The so-called members, or strips, are bonded in some manner to the material from which the bags themselves are manufactured.

Usually, pull flanges extend above the rib and groove strips, which pull flanges may be pulled apart for access to the interior of the bag.

Although flexible zippers of this variety are quite popular, they do not always prevent the inadvertent or unwelcome opening of a bag or package within the store, and various additions have been made to provide tamper-evident seals which would reveal when it has been opened prior to purchase.

U.S. Pat. No. 5,425,825 to Rasko and Share, which is commonly assigned with the present application and which is incorporated herein by reference, shows and provides a solution to these problems in the form of an improved tamper-evident, non-reclosable peel seal suitable for use with reclosable plastic zippers in plastic bags and other packages to provide a hermetic seal until the peel seal is opened for the first time, and to provide a peel seal which is non-reclosable after being opened.

More specifically, in the invention shown in U.S. Pat. No. 5,425,825, reclosable plastic bags and packages are assembled using two interlocking rib and groove members which reclosably seal the plastic bag or package. In the process by which the reclosable plastic bags and packages are assembled, a strip-like area adjacent and parallel to one of the two interlocking rib or groove members is continuously given a treatment, for example, a flame or corona discharge treatment, to cause an adhesive to preferentially adhere to the treated area. The adhesive, which is applied to the treated area to form the peel seal, is retained on the treated area, rather than on the opposed interlocking rib or groove member not so treated, when the peel seal is broken for the first time. Thereafter, the peel seal remains broken, as the adhesive does not have an affinity for the untreated plastic of the opposite rib or groove number once it has been separated therefrom.

U.S. Pat. No. 5,435,864 to Machacek and Share, which is also commonly assigned with the present application and which is also incorporated herein by reference, shows and provides an alternate solution to the same problems, wherein the adhesive is coextruded onto a strip-like area adjacent and parallel to one of the two interlocking rib or groove members of the interlockable zipper profile. In this instance, the coextrusion causes the adhesive to preferentially adhere to the strip-like area, where the flame or corona discharge treatment did above. The adhesive is retained on that area when the peel seal is broken for the first time. As above, the peel seal remains broken, after it is broken for the first time, as the adhesive does not have an affinity for the plastic of the opposite rib or groove member once it has been separated therefrom.

Peel seals are also disclosed in U.S. Pat. Nos. 4,925,318; 4,969,967; and 5,188,461. Each of these patents shows a package having a closure area comprising first and second opposed surfaces. Profiled portions, adapted to be releasably interengaged to permit connection and disconnection of the opposed surfaces, are secured to and extend over each of the opposed surfaces. The profiled portions are each formed integrally with an outer layer of a strip material secured to the associated one of the opposed surfaces. The outer layer of the strip material is formed of a material well-suited for forming a peel-seal weld with the other opposed surface of the package, such as a portion of the outer layer of the opposing strip material. The profiled portions themselves, then, are formed from the peel-seal material. The outer layer of each strip material is secured to the one of the first and second opposed surfaces via a base layer of the strip material to which the outer layer is secured by means of a non-peel-seal type connection. The profile portions, being formed from a peel-seal material, are frequently damaged during the peel-seal welding process, or during the opening of the peel seal when the package is initially opened.

While the inventions shown in U.S. Pat. Nos. 5,425,825 and 5,435,864 have met with considerable success, the need for a tamper-evident, non-reclosable peel seal which would give a clear indication of the integrity thereof upon visual inspection has recently arisen. In this regard, it has proven to be difficult to determine upon a quick visual inspection whether the peel seals shown in the above-noted U.S. patents are sealed or broken. The present invention provides a tamper-evident, non-reclosable peel seal, which gives a positive indication of having been broken when a package is first opened, and which is non-reclosable after being first opened.

SUMMARY OF THE INVENTION

The present invention, then, is a peel seal zipper tape wherein first and second mutually interlocking zipper profiles, such as a male zipper profile and a female zipper profile, are disposed on a top surface of a laminated film strip. The top surface of the strip is formed by a sealant material.

More specifically, the laminated film strip includes three layers: a first layer of a sealant material forming the top surface thereof; a second layer below the first layer; and a third layer below the second, the third layer being of a non-peel-seal material. The second layer is of a material that has limited bond strength with both the sealant material and the non-peel-seal material.

During the production of plastic bags or packages incorporating the present peel seal zipper tape, the zipper tape is folded over so that the zipper profiles disposed on the laminated film strip may be interlocked with one another. The act of folding the zipper tape in this manner leaves portions having a surface of a sealant material facing each other, and portions having a surface of a non-peel-seal material facing outward. Plastic sheet material is bonded to the outwardly facing portions of non-peel-seal material during the manufacture of plastic bags and packages. At the same time, the facing portions of the laminated film strip are sealed to one another.

The peel seal thus formed has the desired characteristic of providing a visual indication of having been initially opened, and is not resealable thereafter. The initial breaking and separation of the peel seal sets up an internal stress within the polymeric resin material in the second layer, causing a whitening or discoloration that provides the desired visual indication of opening.

In an alternate embodiment of the peel seal zipper tape, the laminated film strip has a first layer of a sealant material forming a top surface thereof, and a second layer of a material stiffer than the first and second mutually interlocking profiles beneath the first layer. As before, the zipper profiles are disposed on the top surface of the laminated film strip. The laminated film strip may also have a third layer of a sealant material below the second layer and forming a bottom surface thereof.

The present invention will now be described in more complete detail with reference being made to the figures identified below.

DETAILED DESCRIPTION OF THE PREFERRED EMBODIMENT

Figure 1:
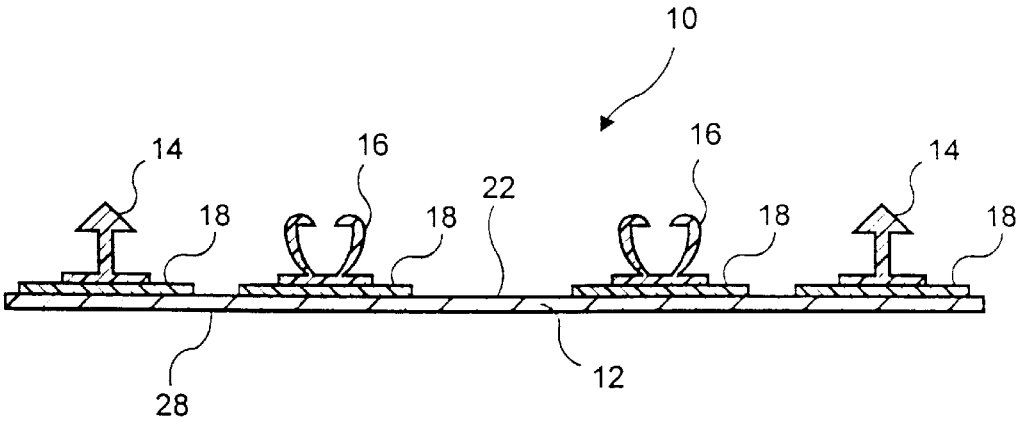
FIG. 1 is a cross-sectional view of a representative embodiment of the peel seal zipper tape of the present invention.

Referring now more particularly to the figures, FIG. 1 is a cross-sectional view of a representative embodiment of the peel seal zipper tape 10 of the present invention. The zipper tape 10 comprises a peel-sealable laminated film strip 12, at least one male zipper profile 14, and at least one female zipper profile 16 interlockable with the male zipper profile 14 to form a resealable closure for a reclosable plastic bag or package. Each male and female zipper profile 14, 16 is applied onto a base web 18, previously applied to the laminated film strip 12.

As will be observed, two male zipper profiles 14 and two female zipper profiles 16 are shown in FIG. 1. It should be understood that the zipper tape 10 may, should a particular application so require, have only one male zipper profile 14 and one female zipper profile 16. It should further be understood that interlockable zipper profiles of designs other than that shown in FIG. 1 may be used in the practice of the present invention, such as zipper profiles having interlocking rib and groove members.

In any event, the male and female zipper profiles 14, 16 may be extruded from a first polymeric resin material onto base webs 18 previously applied to film strip 12. The first polymeric resin material may be polyethylene, preferably a low-density polyethylene (LDPE). Base webs 18 may be applied to film strip 12 by extrusion from a second polymeric resin material and may be flattened onto the film strip 12 by passage therewith through a nip formed between two rolls. The second polymeric material may also be polyethylene, preferably a low-density polyethylene (LDPE).

Figure 2:
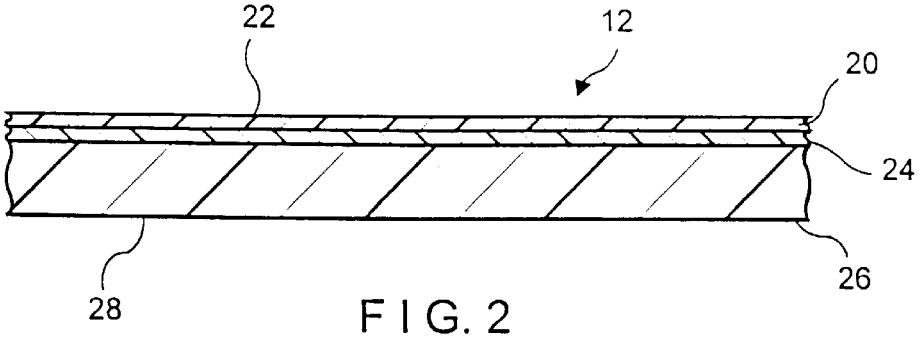
FIG. 2 is a cross-sectional view, enlarged relative to that shown in FIG. 1, of the laminated film strip component of the peel seal zipper tape.

FIG. 2 is an enlarged (relative to FIG. 1) cross-sectional view of film strip 12, which will be seen to comprise three separate and distinct layers. A first layer 20 forms a top surface 22 of the film strip 12 and comprises a third polymeric resin material. The third polymeric resin material is a sealant material. Because the top surface 22 of the film strip 12 is formed by a sealant material, when the film strip 12 is folded in such a way that the top surface 22 is within the fold, the facing top surfaces 22 may be sealed to one another. Therein lies the purpose for incorporating laminated film strip 12 into the present invention.

The third polymeric resin material (sealant material) may be an ethylene vinyl acetate (EVA) copolymer material having a strong adhesion to polyethylene. This is especially so where the base webs 18 have been extruded from polyethylene. In general, the third polymeric resin material (sealant material) of the first layer 20 should have a strong adhesion to the second polymeric resin material of the base webs 18, so that the base webs 18 may be firmly attached to the top surface 22 of the laminated film strip 12 when applied thereto.

Laminated film strip 12 also has a second (middle) layer 24, comprising a fourth polymeric resin material, and a third layer 26, comprising a fifth polymeric resin material which forms a bottom surface 28 for the film strip 12. The fifth polymeric resin material is a non-peel-sealable material, so that the bottom surface 28 of the film strip 12 may be non-removably sealed to plastic film or sheet material from which plastic bags or packages are fashioned. The fifth polymeric resin material may also be polyethylene, preferably low-density polyethylene (LDPE).

The fourth polymeric resin material of the second (middle) layer 24 separates the third polymeric resin material (sealant material) of the first layer 20 from the fifth polymeric resin material (non-peel-seal material) of the third layer 26. The fourth polymeric resin material has a limited adhesion to the third polymeric resin material (sealant material), and a limited adhesion (incompatibility) to the fifth polymeric resin material (non-peel-seal material), so that the second (middle) layer 24 will separate from the first layer 20 and the third layer 26 in the region of a peel seal, when the peel seal is initially broken. The forces associated with the separation cause a whitening or discoloration in the fourth polymeric resin material of the second (middle) layer 24 in the region of the broken peel seal, giving an obvious visual indication that the peel seal has been broken.

Peel-sealable laminated film strips 12 of the variety with which the present invention may be practiced may be obtained from Curwood, Inc. of Oshkosh, Wis., U.S.A. under product numbers 1834K and 1837. Peelable films of this type are designed to be heat-sealed to themselves or to other films, and to be peeled apart under known, predictable forces. When peeled apart, the separation mechanism is delamination within the peelable film itself. The delamination, which comprises one layer peeling off of its neighboring layer within the film structure, occurs because the bond between the two layers is weaker than the bond between the peelable film and the material to which it is sealed. These films, when peeled open, usually show a frosted white imprint indicating where they had been sealed together.

Figure 3A:
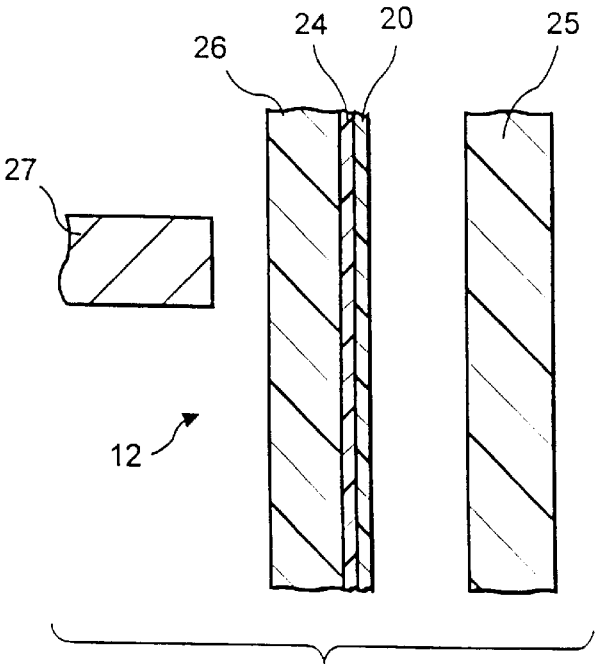
FIGS. 3*a*, 3*b* and 3*c* illustrate how the laminated film strip component functions.
Figure 3B:
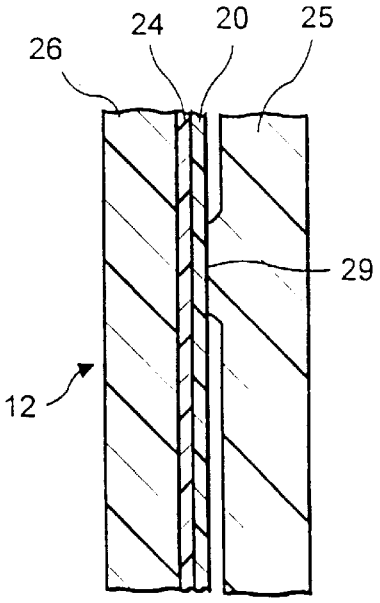
Figure 3C:
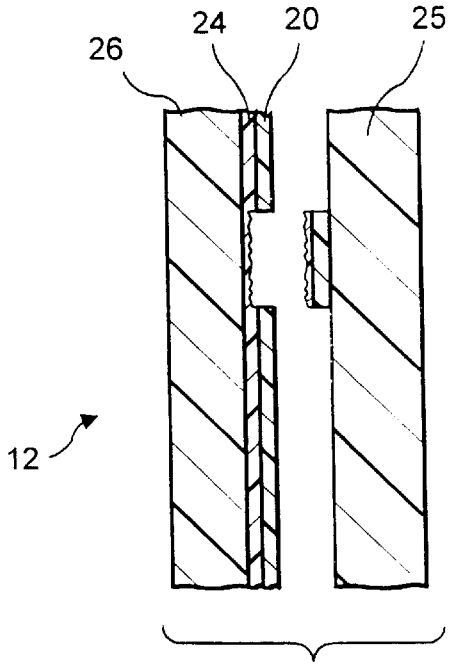

FIGS. 3*a*, 3*b* and 3*c* illustrate how these peelable films function. In FIG. 3*a*, laminated film strip 12 is disposed adjacent to a film 25. A heat-seal sealing bar 27 is disposed adjacent to laminated film strip 12 to heat-seal it to film 25. FIG. 3*b* shows the heat seal 29 produced by heat-seal sealing bar 27 between the first layer 20 of laminated film strip 12 and film 25. FIG. 3*c* shows the separation of heat seal 29 caused by the delamination of the second (middle) layer 24 from the first layer 20 and the third layer 26 when the heat seal 29 is broken. The present invention combines peelable films of this type with reclosable plastic zippers.

The peel seal zipper tape 10 of the present invention may be used as described in the following example, although it should be understood that the use of the zipper tape 10 is not limited to the type of package shown in that example.

Figure 4:
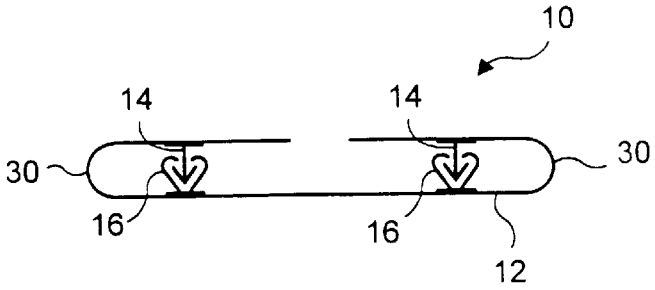
FIGS. 4 through 9 illustrate a process by which plastic packages incorporating the peel seal zipper tape may be manufactured.

FIG. 4 is a schematic cross-sectional view of the zipper tape 10 shown in FIG. 1. Film strip 12 has been folded at each end and male zipper profiles 14 interlocked with their neighboring female zipper profiles 16. The third polymeric resin material (sealant material) of the first layer 20 of the laminated film strip 12 is disposed within the folds 30, so that seals between the facing portions of the film strip 12 may ultimately be formed.

Figure 5:
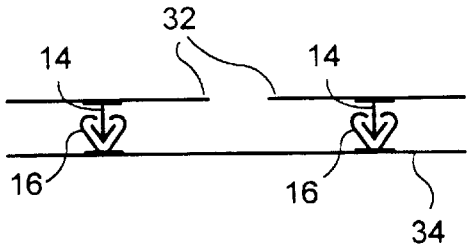

FIG. 5 shows a typical next step wherein the laminated film strip 12 is cut or slit at folds 30, so that male zipper profiles 14, interlocked with female profiles 16, are disposed on short webs 32 of film strip 12, while female profiles 16 are disposed on long web 34 of film strip 12.

Figure 6:
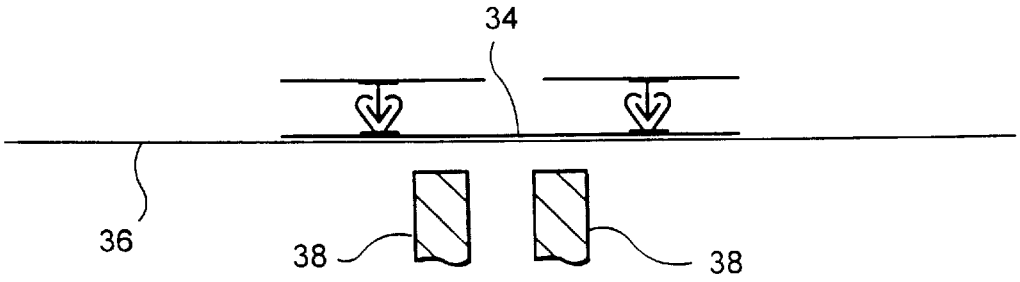

FIG. 6 shows the attachment of a bottom sheet 36 of plastic packaging film to the underside of the long web 34, the underside of the long web 34 being that side of the film strip 12 formed by the fifth polymeric resin material (non-peel-sealable material) on the bottom surface 28 thereof. Heat-seal sealing bars 38 bond the long web 34 to the bottom sheet 36.

Figure 7:
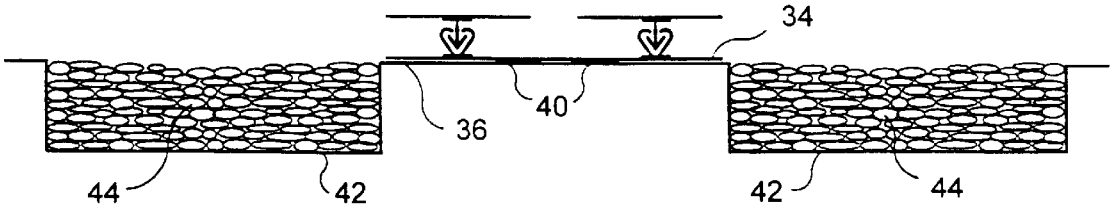

FIG. 7 shows seals 40 produced by heat-seal sealing bars 38 between long web 34 and bottom sheet 36. Pockets 42 are formed in bottom sheet 36 for a consumer food product 44.

Figure 8:
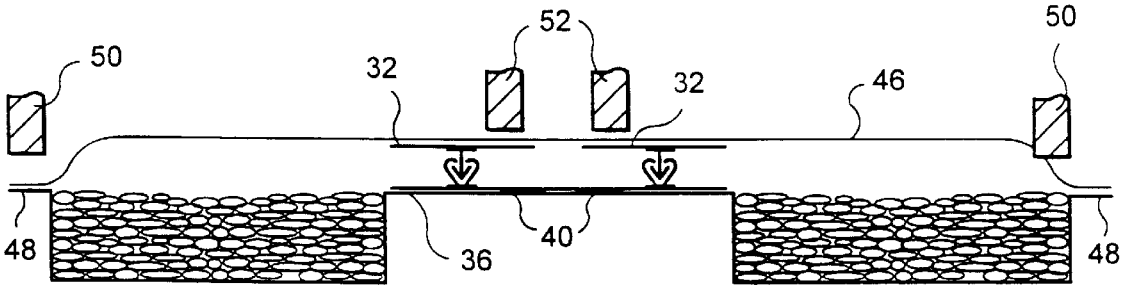

FIG. 8 shows the attachment of a top sheet 46 of plastic packaging film to the topsides of the short webs 32 and to the edges 48 of bottom sheet 36. The topsides of the short webs 32 are that side of the film strip 12 formed by the fifth polymeric resin material (non-peel-sealable material) on the bottom surface 28 thereof. Heat-seal sealing bars 50 bond the top sheet 46 to the edges 48 of bottom sheet 36. Heat-seal sealing bars 52 bond the top sheet 46 to the topsides of the short webs 32, forming seals 54, shown in FIG. 8. At the same time, heat-seal sealing bars 52 form peel seals 56 between the short webs 32 and the long web 34.

Figure 9:
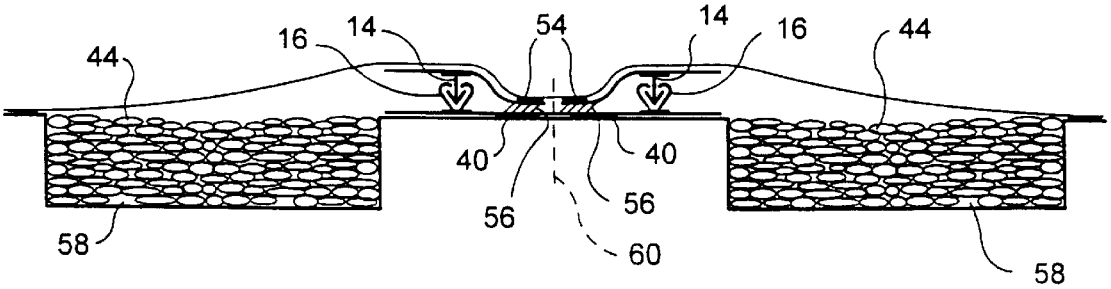

FIG. 9 shows the end result of the process, two packages 58 filled with a consumer food product 44, each package 58 having a tamper-evident, non-reclosable peel seal 56 and a reclosable opening formed by interlocking male and female zipper profiles 14, 16. The two packages 58 may be separated from one another by cutting at the point indicated by the dashed line 60. Further, the mouths of each of the two packages 58 may be sealed external to the peel seals 56, and may be provided with perforations, so that a consumer may tear open the mouth of a package 58 as a first step in gaining access to the contents (consumer food product 44) thereof.

Figure 10:
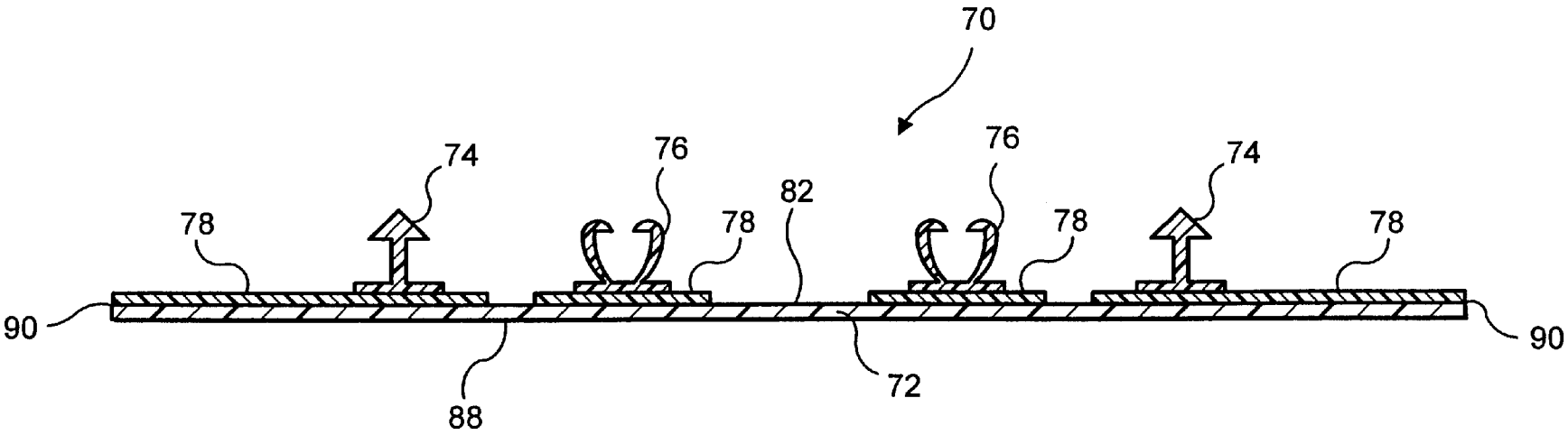
FIG. 10 is a cross-sectional view of an alternate embodiment of the peel seal zipper tape of the present invention.

FIG. 10 is a cross-sectional view of an alternate embodiment of the peel seal zipper tape 70. The zipper tape 70 comprises a peel-sealable laminated film strip 72, at least one male zipper profile 74, and at least one female zipper profile 76 interlockable with the male zipper profile 74 to form a resealable closure for a reclosable plastic bag or package. Each male and female zipper profile 74, 76 is applied onto a base web 78, previously applied to the laminated film strip 72.

As will again be observed, two male zipper profiles 74 and two female zipper profiles 76 are shown in FIG. 10. It should be understood that the zipper tape 70 may, should a particular application so require, have only one male zipper profile 74 and one female zipper profile 76. It should further be understood that interlockable zipper profiles of designs other than that shown in FIG. 10 may be used in the practice of the present invention, such as zipper profiles having interlockable rib and groove members.

In any event, the male and female zipper profiles 74, 76 may be extruded from a first polymeric resin material onto base webs 78 previously applied to film strip 72. The first polymeric resin material may be polyethylene, preferably a low-density polyethylene (LDPE). Base webs 78 may be applied to film strip 72 by extrusion from a second polymeric resin material and may be flattened onto the film strip 72 by passage therewith through a nip formed between two rolls. The second polymeric material may also be polyethylene, preferably a low-density polyethylene (LDPE).

Figure 11:
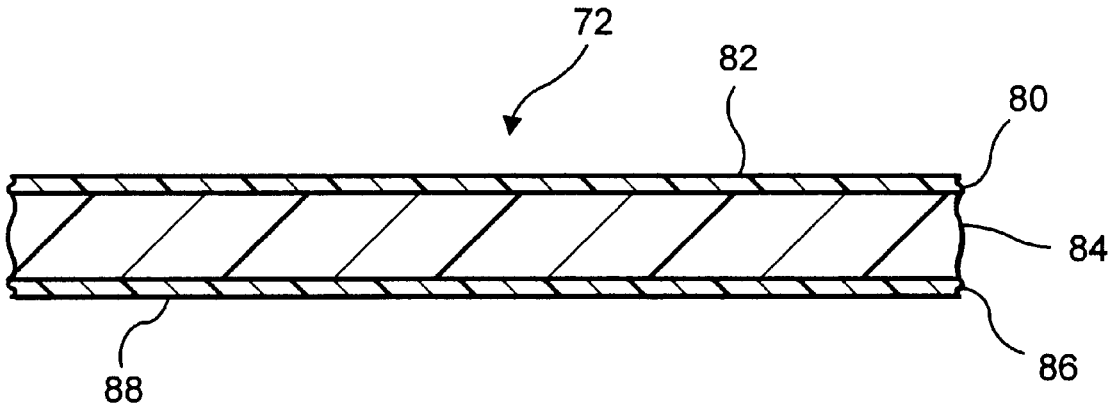
FIG. 11 is a cross-sectional view, enlarged relative to that shown in FIG. 10, of the laminated film strip component of the alternate embodiment of the peel seal zipper tape.

FIG. 11 is an enlarged (relative to FIG. 10) cross-sectional view of film strip 72. which will be seen to comprise three separate and distinct layers. A first layer 80 forms a top surface 82 of the film strip 72 and comprises a third polymeric resin material. The third polymeric resin material is a sealant material. Because the top surface 82 of the film strip 72 is formed by a sealant material, when the film strip 72 is folded in such a way that the top surface 82 is within the fold, the facing top surfaces 82 may be sealed to one another.

The third polymeric resin material (sealant material) may be an ethylene vinyl acetate (EVA) copolymer material having a strong adhesion to polyethylene. This is especially so where the base webs 78 have been extruded from polyethylene. In general, the third polymeric resin material (sealant material) of the first layer 80 should have a strong adhesion to the second polymeric resin material of the base webs 78, so that the base webs 78 may be firmly attached to the top surface 22 of the laminated film strip 72 when applied thereto.

Laminated film strip 72 also has a second (middle) layer 84 comprising a fourth polymeric resin material. The fourth polymeric resin material of the second layer 84 of the film strip 72 is stiffer than the first and second polymeric resin materials of the male and female zipper profiles 74, 76 and base webs 78, respectively. The fourth polymeric resin material is preferably a high-density polyethylene (HDPE). The use of a stiffer material as the core (second layer 84) of film strip 72 provides the film strip 72 with stiffness and strength, so that it will have less of a tendency to stretch on a form-fill-and-seal machine.

Finally, laminated film strip 72 has a third (bottom) layer 86 comprising a fifth polymeric resin material which forms a bottom surface 88 for the film strip 72. The fifth polymeric resin material is also a sealant material, such as an ethylene vinyl acetate (EVA) copolymer material having a strong adhesion to polyethylene. This is especially so where the second (middle) layer 84 is of high-density polyethylene (HDPE). The third (bottom) layer 86 is used to seal the laminated film strip 72 to plastic film or sheet material from which plastic bags or packages are fashioned.

Figure 12:
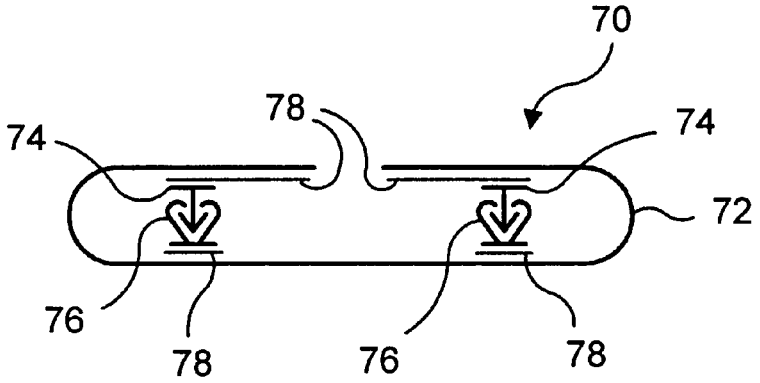
FIG. 12 is a schematic cross-sectional view, analogous to that provided in FIG. 4, of the folded alternate embodiment of the peel seal zipper tape.

Referring, for a moment, back to FIG. 10, it will be noted that the outboard base strips 78 beneath male zipper profiles 74 extend outward to the lateral edges 90 of the peel seal zipper tape 70. As a consequence, when zipper tape 70 is folded in the manner shown in the schematic cross-sectional view provided in FIG. 12, which is similar to FIG. 4 above, these outboard base strips 78 face the top surface 82, formed by the first layer 80 of sealant material, of the laminated film strip 72, to which they may later be sealed in the manner previously shown in FIG. 8. The seal between the outboard base webs 78 and the first layer 80 of sealant material is a peel seal. As above, when this peel seal is initially broken, the forces associated with the separation cause a whitening or discoloration in the first layer 80 of sealant material in the laminated film strip 72 in the region of the broken peel seal, giving an obvious visual indication that the peel seal has been broken.

Modifications to the above would be obvious to those skilled in the art, but would not bring the invention so modified beyond the scope of the appended claims.

What is claimed is:

1. A peel seal zipper tape comprising a first and a second mutually interlocking zipper profile and a laminated film strip, said laminated film strip having a first layer of a first sealant material forming a top surface thereof and a second layer beneath said first layer, said zipper profiles being disposed on said top surface of said laminated film strip, a lateral edge of said laminated film strip, a first base web disposed between said first mutually interlocking zipper profile and said top surface of said laminated film strip extending to said laminated film strip lateral edge, said first base web being formed of a material different from said first sealant material and a second base web disposed between said second mutually interlocking zipper profile and said top surface of said laminated film strip.

2. A peel seal zipper tape as claimed in claim 1 wherein said first and said second mutually interlocking zipper profiles are extruded from polyethylene.

3. A peel seal zipper tape as claimed in claim 2 wherein said polyethylene is a low density polyethylene (LDPE).

4. A peel seal zipper tape as claimed in claim 1 wherein said first base web is extruded from polyethylene.

5. A peel seal zipper tape as claimed in claim 1 wherein said first layer of sealant material is formed of ethylene vinyl acetate (EVA).

6. A peel seal zipper tape as claimed in claim 1 wherein said second base web material is extruded from the same material as said first base web.

7. A peel seal zipper tape as claimed in claim 1 wherein said second base web is shorter that said first base web.

* * * * *

UNITED STATES PATENT AND TRADEMARK OFFICE

CERTIFICATE OF CORRECTION

PATENT NO. : 5,930,877

DATED : August 3, 1999

INVENTOR(S) : Thorpe, et. al.

It is certified that error appears in the above-identified patent and that said Letters Patent is hereby corrected as shown below:

Title page, item [75], inventors: should read as following:

Charles C. Thorpe, Des Plaines;
Gregory J. Pagnier, Bourbonnais;
Lawrence Share, Skokie, all of Ill.

Signed and Sealed this

Thirtieth Day of November, 1999

*Attest:*

*Attesting Officer*

Q. TODD DICKINSON

*Acting Commissioner of Patents and Trademarks*